US005457294A

United States Patent [19]

Kato et al.

[11] Patent Number: 5,457,294

[45] **Date of Patent: * Oct. 10, 1995**

[54] UHV BREAKER PROVIDED WITH RESISTANCES

[75] Inventors: Norimitsu Kato; Hiroshi Sato, both of Yokohama; Shigeki Nishizumi, Tokyo; Hiroaki Toda; Hisatoshi Ikeda, both of Yokohama, all of Japan

[73] Assignee: Kabushiki Kaisha Toshiba, Kawasaki, Japan

[ * ] Notice: The portion of the term of this patent subsequent to Mar. 28, 2012 has been disclaimed.

[21] Appl. No.: 77,918

[22] Filed: Jun. 18, 1993

[30] Foreign Application Priority Data

Jun. 18, 1992 [JP] Japan ..... 4-159779

[51] Int. Cl.[6] ..... H01H 33/16; H01C 13/00

[52] U.S. Cl. ..... 218/143; 200/48 R; 338/215; 218/2

[58] Field of Search ..... 338/215; 361/341; 200/48 R, 49 P, 48 A, 49, 144 R, 145, 144 AP

[56] References Cited

U.S. PATENT DOCUMENTS

| | | | |
|---|---|---|---|
| 3,842,225 | 10/1984 | Leeds | 200/144 AP |
| 4,009,458 | 2/1977 | Kishi et al. | 200/148 A |
| 4,268,490 | 4/1981 | Pham Van | 200/144 AP |
| 4,434,333 | 2/1984 | Kawasaki . | |
| 4,454,394 | 6/1994 | Toyoda | 200/145 |
| 4,499,350 | 2/1985 | Hidake | 200/144 AP |
| 5,245,145 | 9/1993 | Freeman et al. | 200/144 AP |

FOREIGN PATENT DOCUMENTS

| | | |
|---|---|---|
| 0050826 | 5/1982 | European Pat. Off. . |
| 334168 | 5/1991 | Japan . |
| 354408 | 8/1991 | Japan . |
| 660645 | 5/1987 | Switzerland . |

*Primary Examiner*—Marvin M. Lateef
*Attorney, Agent, or Firm*—Oblon, Spivak, McClelland, Maier & Neustadt

[57] ABSTRACT

A resistance-provided UHV breaker includes a tank, a main contact unit, a resistance unit, and a resistance contact unit. The main contact unit includes plural main contacts arranged in the axial direction of the tank. The resistance unit includes plural resistances arranged in the axial direction of the tank. The resistance contact unit cooperates with the resistance unit to form a resistant parallel circuit and it is arranged, crossing the axial direction of the tank. The main and resistance contact units are opened and closed by an operating mechanism arranged outside the tank.

12 Claims, 4 Drawing Sheets

UHV BREAKER PROVIDED WITH RESISTANCES

BACKGROUND OF THE INVENTION

1. Field of the Invention

The present invention relates to a UHV (Ultra High Voltage) breaker used in an ultra high voltage power plant such as the substation on a million-volt power supply system line and, more particulaly, a resistance-provided breaker wherein resistance contacts for allowing making and breaking to be achieved through resistances are connected parallel to main contacts for allowing making and breaking to be achieved through no resistance.

2. Description of the Related Art

The breakers provided with making resistances have been well-known as being suitable for 500,000 volts power supply system. When power is added to the unloaded transmission lane, large overvoltage results. In order to suppress this overvoltage, the breaker of this kind is arranged to make resistances operative about 10 ms before the main contacts are connected. After the overvoltage is thus suppressed in this manner, the main contacts are connected.

One of these making-resistance-provided breakers is shown in FIG. 1. In the case of the resistance-provided breaker shown an FIG. 1, a cylindrical breaker tank 6 has a manhole 7. Main contacts 1 connected to external conductors 5 are housed in the cylindrical breaker tank 6. Main contacts and resistance contacts 2 are arranged parallel to the longitudinal center axis of the tank 6. The main contacts 1 and resistance contacts 2 are arranged to align their end positions with each other. A resistance 3 connected in series to each resistance contact 2 is arranged in a space between the main contacts 1 and the resistance contacts 2 in the longitudinal direction of the tank 6. The main contacts and resistance contacts 2 are connected to the operation mechanism 4 through crank mechanisms 8.

According to the conventional engineering having the above-described arrangement, each resistance 3 can be conveniently housed in the space between the main contacts 1 and the resistance contacts 2. This enables the breaker to be made smaller in size.

Power supplied through the transmission line becomes higher and higher in voltage and power of ultra high voltage such as one million volts is planned to be supplied through the transmission line. In the case of the UHV breaker used for this transmission line, resistances are inserted parallel to the main contacts at the time of breaking. The rise of recovery voltage caused in the main contacts after the breaking of the breaker is thus reduced to make the breaking easy. Resistances are also inserted parallel to the main contacts to suppress overvoltage caused after the breaking when earthed. It is needed that these resistances are separated from the circuit 30–40 ms after the breaking of the main contacts is finished. This makes it necessary that the resistances are connected parallel to the main contacts and that resistance contacts are also arranged in series to the resistances to select the timing at which the resistances are separated from the circuit.

It is therefore supposed that the making resistances and the making resistance contacts used for the 500,000 volts breaker are commonly used as those resistances and contacts which are needed for the UHV breaker at the time of breaking or after the breaking.

In the case of the UHV breaker, however, each resistance is needed to have a heat capacity 30 or 40 times larger than that of the resistance used for the 500,000 volts breaker, because voltage becomes doubled and the time during which power is supplied becomes 3 or 4 times. In short, each resistance for the UHV breaker must be made larger in size to have such a large heat capacity. When the conventional resistance-provided breaker shown in FIG. 1 is to be used as the UHV breaker which needs larger-sized resistances. However, the volume of each of the resistances 3 becomes so large as to create a large unnecessary space in the tank 6, as shown in FIG. 2. The resistance contacts 2 serve only to achieve making operation in the case of the 500,000 volts breaker, but it is needed in the case of the UHV breaker that resistance current is shut off after the breaking of the main contacts 1 is finished. Further, the resistance contacts 2 are asked to achieve a complicated operation in such a way that they are opened 30–40 ms after the main contacts 1 when power is shut off. The linkage system including the operation and crank mechanisms 4 and 11 must be therefore made more complicated and larger in size.

On the other hand, the breaker must be designed in such a way that its insulation recovering characteristics becomes quicker as voltage used becomes higher and higher. The breaker section of the UHV breaker, as described above, must have the high speed opening system. It is therefore preferable that the linkage system for connecting the operation mechanism 4 to the breaking section is made as simple as possible in structure to enable the breaker to have high reliability. In other words, it is quite important in order to enhance the reliability of the breaker how compactly the main contacts 1, the resistance contacts 2 and the resistances 3 can be housed in the tank 6 and how simple the linkage system for connecting the operation mechanism 4 to the breaking section can be made in structure.

In the case of the UHV breaker as described above, however, all of the components become large in size and particularly the resistances 3 becomes the largest of all. It is therefore impossible to make the breaker compact unless the conventional arrangement of the resistances 3 in the tank 6 is changed.

In the breaker of this kind, each main contacts 1 is usually supported in cantilever manner by a box-like center piece member (not shown) which is arranged in the center of the tank 6 and which has high mechanical strength. In the case of each resistance contacts 2 which is arranged parallel to the main contacts 1, therefore, its end portion which is located on the center side of the tank is also supported in cantilever manner by the center piece. When the resistances 3 is small in size and light in weight as seen in the case of the 500,000 volts breaker shown in FIG. 1, it can be supported by the front end of the resistance contacts 2 which is supported in cantilever manner by the center piece. In the case of the UHV breaker shown in FIG. 2, however, each resistances 3 is large in size and heavy in weight. It becomes difficult, therefore, to support the resistances 3 only by the front end of the cantilever-supported resistance contacts 2. It is necessary for the conventional UHV breaker to have a support insulator 10 arranged between the resistance contacts 2 and the resistances. The mechanism described above is very complicated. Unless these support insulators are added to the breaker, there is fear that some components become loose and come out of the breaker when the breaker is being transported or when it is used.

SUMMARY OF THE INVENTION

An object of the present invention is therefore to provide a resistance-provided breaker capable of housing main and resistance contacts and resistances in a tank in such a better balance that does not waste space in the tank in order to make the breaker smaller in size, makes the linkage system for connecting an operation mechanism to the contacts simpler to enhance the reliability of the breaker, and more stably fixing each resistance, large and heavy, to the tank.

The object of the present invention can be achieved by a resistance-provided UHV breaker comprising a tank; a main contact unit arranged in the tank in the axial direction thereof; a resistance unit arranged in the tank in the axial direction thereof; and a resistance contact unit arranged, crossing the axial direction of the tank, and serving to cooperate with the resistance unit to form the resistant parallel circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
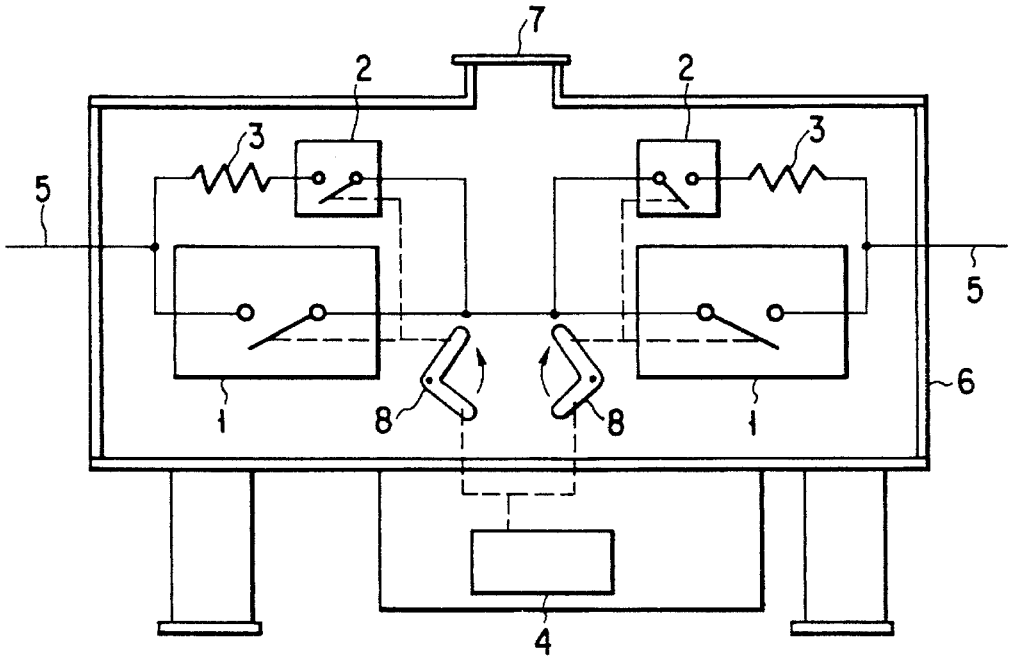
F I G. 1 (PRIOR ART)
FIG. 1 is a sectional view showing an example of the conventional 500,000 volts breaker provided with resistances.
Figure 2:
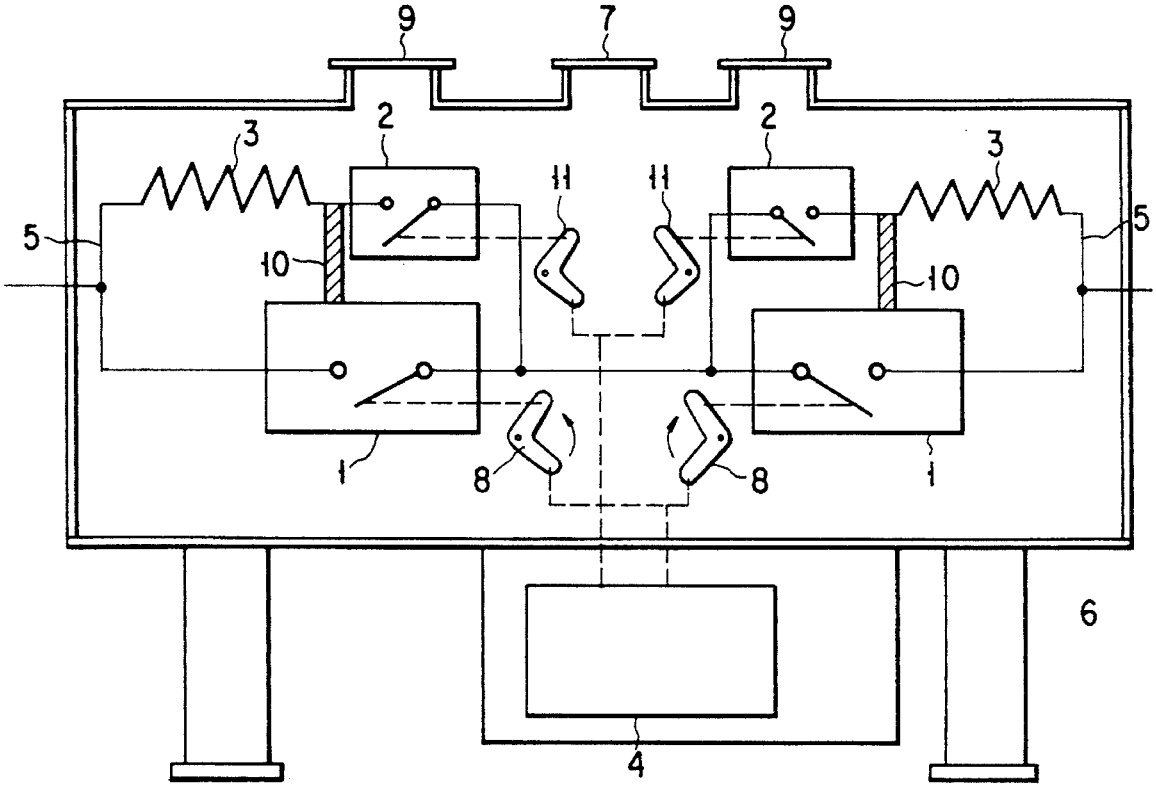
F I G. 2 (PRIOR ART)
FIG. 2 is a sectional view showing a UHV breaker provided with resistances originated from the breaker shown in FIG. 1.
Figure 3:
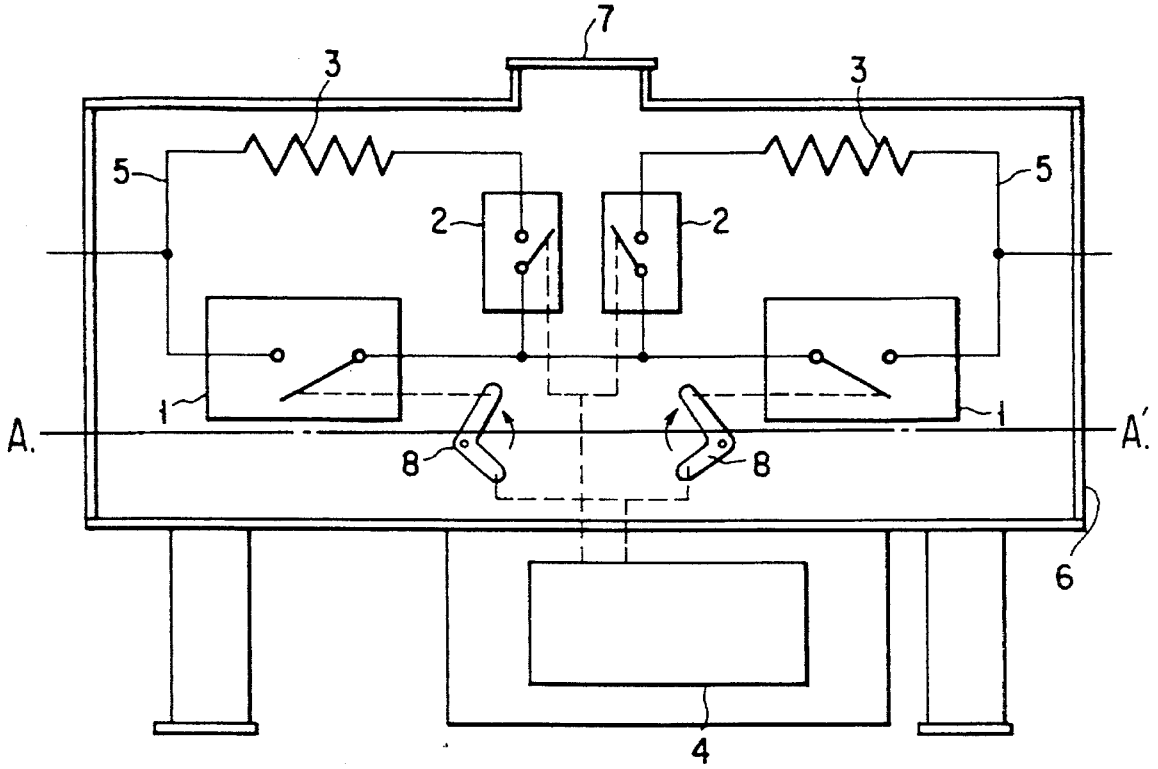
FIG. 3 is a sectional view showing the UHV breaker provided with resistances according to an embodiment of the present invention.

An embodiment of the present invention will be described in detail, referring to FIG. 3. The present invention is applied, in this case, to the UHV gas insulated breaker of the double breaking type and this UHV gas insulated breaker thus embodied comprises a main contact unit including two main contacts 1, a resistance contact unit including two resistance contacts 2, and a resistance unit including two resistances 3. From results obtained by analyzing the suppression of overvoltage in the UHV breaker, it is needed in this case that the resistances of the UHV breaker provide a total of 750 Ω of resistance. The resistance value of one resistance 3 is about 350 Ω. The lengthwise dimension of the resistance 3 is made substantially same as that of the main contact 1 by combining resistance elements in series and parallel.

An operation mechanism 4 is located under the center portion of an insulating-gas-sealed breaker tank 6. The operation mechanism 4 is designed to operate its operation rod in a direction perpendicular to the longitudinal direction of the tank 6 so as to open and close the main contacts 1 and the resistance contacts 2. The longitudinal direction of the tank is parallel to line AA' illustrated in FIG. 3. Those ends of the main contacts 1 and the resistance contacts 3 which are located on the side of the operation mechanism 4 are combined and arranged along the longitudinal direction of the tank 6.

Each resistance contact 2 is arranged along a direction perpendicular to the longitudinal direction of the tank 6. The direction in which each resistance contact 2 is opened and closed corresponds to that direction in which the operation mechanism 4 is operated. As seen in the case of the conventional breakers, the main contact 1 is fixed relative to a center piece by a cantilever breaker and the resistance contact 2 is fixed vertical onto the center piece.

In the resistance-provided breaker having the above-described arrangement, the resistances 3 and the main contacts 1 are arranged parallel to the longitudinal direction of the tank 6. The space in the tank 6 can be thus more efficiently used and the length and diameter of the tank 6 can be made smaller.

The opening and closing direction of the resistance contacts 2 is the same as that direction in which the operation mechanism 4 is operated. This makes it unnecessary to use the crank mechanism. In addition, the structure of the breaker thus achieved can be made simpler and more reliable. Further, each resistance contact 2 is fixed to the upper surface of the center piece at a right angle. The resistance contacts 2 thus attached can have, therefore, a higher strength and stability, as compared with those fixed in cantilever manner as seen in the conventional cases. Still further, each resistance 3 which is connected to the resistance contact 2 is supported not in cantilever manner but by the resistance contact 2 which has been firmly fixed to the center piece. This makes it unnecessary to use the conventional support members 10 made of insulating matter. Still further, two resistance contacts 2 of the double breaking tape breaker are located in the center portion of the tank 6. Therefore, a manhole 7 arranged on the center top of the tank 6 to allow the crank mechanism for the main contacts 1 to be checked therethrough can also be used to check the resistance contacts 2 and 2 and to exchange them with new ones through at. This makes it unnecessary to provide another manhole of the resistance contact independently of the manhole 7. The tank 6 can be thus made simpler.

The resistance-provided breaker according to another embodiment of the present invention will be described in detail with reference to FIGS. 4–7. This second embodiment is also a UHV gas-insulated breaker of the double breaking type.

Figure 5:
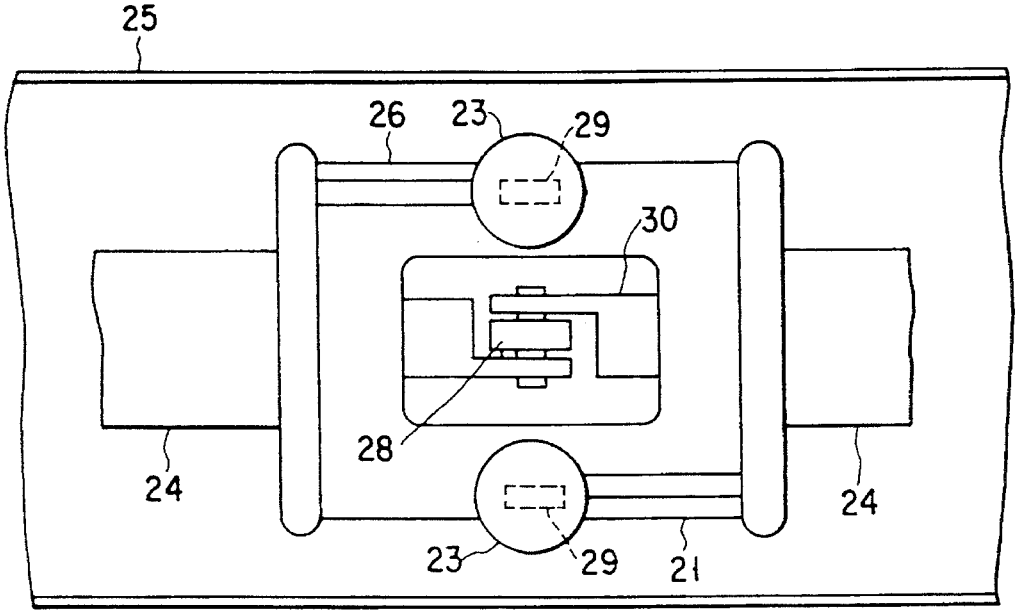
FIG. 5 is a plan showing the UHV breaker provided with resistances viewed in a direction shown by an arrow 700 in FIG. 4.
Figure 4:
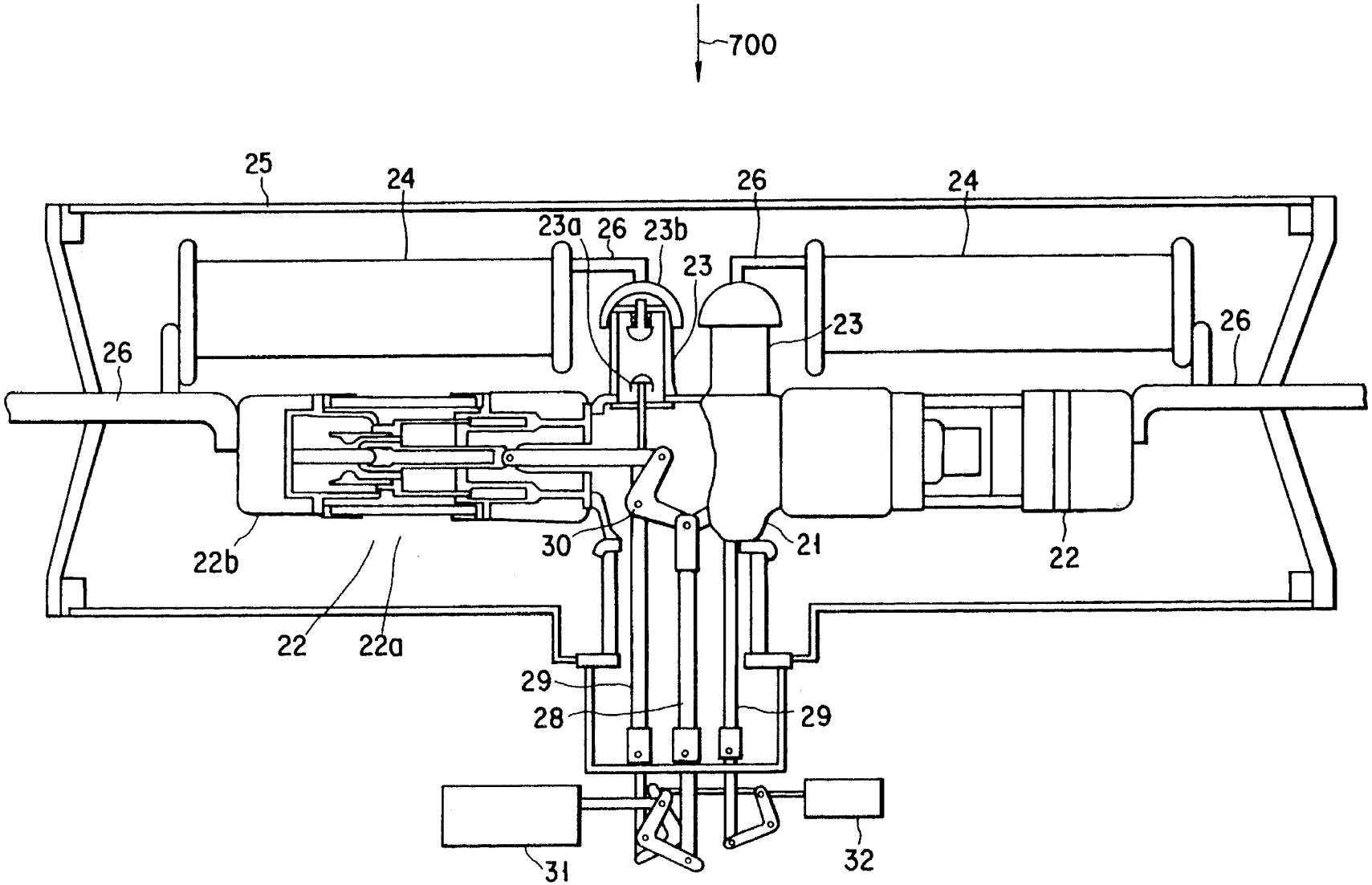
FIG. 4 is a side view showing the UHV breaker provided with resistances according to the embodiment of the present invention.

FIG. 5 is a plan showing the arrangement of the resistance contacts 2 according to the present invention. Two resistance contacts 23 are arranged in a direction perpendicular to the longitudinal direction of a tank 25 when viewed in the horizontal direction of the tank. Each resistance contact 23 is attached to the top of a resistance contact operating rod 29. Each resistance contact operating rod 29 is arranged at a right angle relative to the tank 25. The resistance contact operating rods 29 are attached to an operation mechanism (not shown).

A main contact operating rod 28 is arranged between the resistance contact operating rods 29. It is arranged at a right angle relative to the tank 25 and supported by swing links 30. The swing links 30 are connected, as described above, to the operation mechanism (not shown) by which the main contacts 22 are operated.

Each resistance contact 23 comprises fixed and movable electrodes and it is well-known that extremely high recovery voltage is caused between the fixed electrodes when current is shut off. It is therefore needed that a long insulating distance is kept between the fixed electrodes of two resistance contacts 23.

A center piece 21 is usually located between the two resistance contacts 23. The center piece 21 is a box-like support insulator and the resistance contacts 23 are arranged on those inner walls of the center piece 21 which are opposed to each other. Reference numeral 26 represents conductors, by which the resistance contacts 23 are connected to resistances 24 to form a predetermined circuit.

Figure 6:
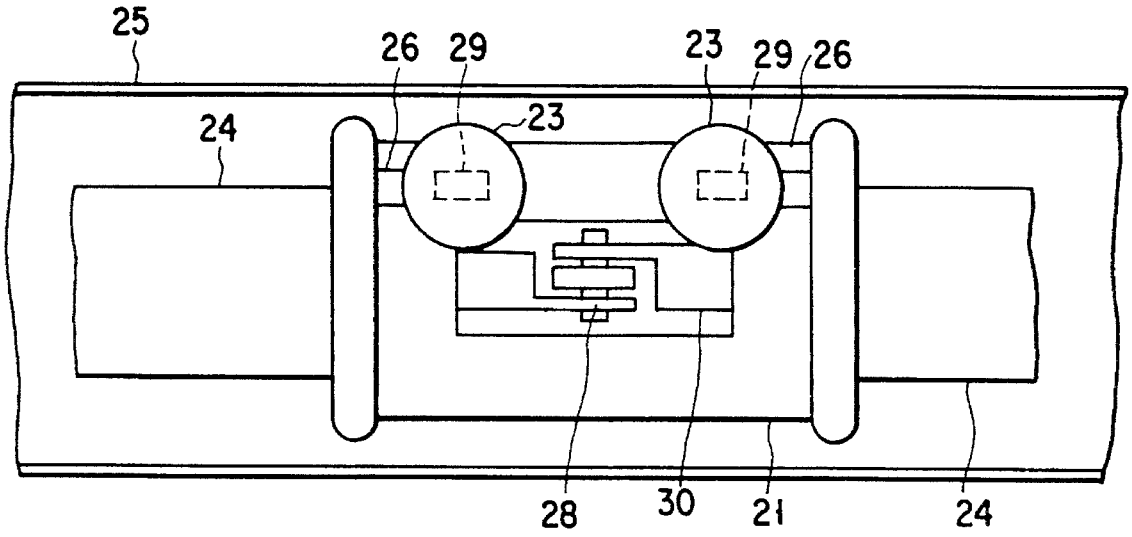
FIG. 6 is a plan showing the breaker according to the other embodiment of the present invention.

FIG. 6 is a plan showing the breaker according to the other embodiment of the present invention.

Insulating gas is sealed in a cylindrical tank 25. Center piece 21 is arranged in the cylindrical tank 25. Main contacts 22 and resistances 24 are arranged on both sides of the center piece 21 in such a way that their longitudinal axes are made parallel to the longitudinal direction of the tank 25. The main contact 22 and the resistance 24 are electrically connected in parallel to each other. Further, the main contact 22 includes movable and fixed electrodes **22*a* and 22*b*. When the movable electrode 22*a* is moved in the longitudinal direction of the tank 25, the main contact 22** is opened and closed.

Two resistance contacts 23 are arranged, perpendicular to the longitudinal direction of the tank 25, on both sides of the upper surface of the center piece 21. They are electrically connected in parallel to the main contacts 22 but in series to the resistances 24. They are also connected in series to each other via the center piece 21. Each resistance contact 23 comprises movable and fixed electrodes **23*a* and 23*b*. When the movable electrode 23*a* is moved in a direction perpendicular to the longitudinal direction of the tank 25, the resistance contact 23 is opened and closed. Conductors 26 are attached to these main contact 22, resistance contact 23 and resistance 24. They are connected to one another via these conductors 26 to form a predetermined circuit. A main contact operating rod 28 and two resistance contact operating rods 29 are arranged, perpendicular to the longitudinal direction of the tank 25, an the center piece 21. These main and resistance contact operating rods 28 and 29 are arranged at a position which is shifted from an axis perpendicular to the longitudinal direction of the tank 25**.

The top of the main contact operating rod 28 is connected to an end of a swing link 30. The swing link 30 changes the moving direction of the main contact operating rod 28 by 90 degrees. The other ends of the swing link 30 are connected to the movable electrodes **22*a* of two main contacts 22. The bottom end of the main contact operating rod 28 is connected to an operating mechanism 31 outside the tank 25. Tops of the resistance contact operating rods 29 are connected directly to the movable electrodes 23*a* of the resistance contacts 23. Their bottom ends are connected to an operating mechanism 32 outside the tank 25**.

The main contact operating rod 28 is positioned substantially in the center of the center piece 21. It is made operative in the direction perpendicular to the longitudinal direction of the tank 25. Its operation is changed by the swing link 30. In short, the swing link 30 moves the main contact operating rod 28 an the longitudinal direction of the tank 25, thereby causing the movable electrodes **22*a* of both main contacts 22** to be moved.

On the other hand, the resistance contact operating rods 29 move perpendicular to the longitudinal direction of the tank 25 to directly move the movable electrodes **23*a* of the resistance contacts 23** in the same direction without any link interposed.

According to the above-described second embodiment of the present invention, the main and resistance contact operating rods 28 and 29 are shifted from a straight line perpendicular to the longitudinal center axis of the tank 25. Two resistance contact operating rods 29 can be therefore be placed near to both ends of the upper surface of the center piece 21. The resistance contacts 23 which are attached directly to the resistance contact operating rods 29 can be thus positioned more adjacent to both ends of the center piece 21 when viewed in the longitudinal direction of the piece 21. As the result, an insulating distance long enough can be kept between the fixed electrodes **23*b* of the resistance contacts 23** in which high recovery voltage is caused when power is shut off.

According to the second embodiment of the present invention, the insulating distance can be made long enough between the fixed electrodes **23*b* by locating the resistance contacts 23 more adjacent to both ends of the upper surface of the center piece 21 when viewed in the longitudinal direction of the piece 21. This makes it unnecessary to make the diameter of the center piece 21 larger. The size of the tank 25 in which the center piece 21** is housed can be thus left minimum, thereby enabling the whole of the breaker to be kept smaller in size.

Further, the resistance contacts 23 are located on the upper surface of the center piece 21 and they are opened and closed in the direction perpendicular to the longitudinal direction of the tank 25. Operations of the resistance contact operating rods 29 can be thus transmitted directly to the resistance contacts 23 without any swing link interposed. Therefore, no loss is caused in the force with which the resistance contact operating rods 29 are operated, and the resistance contact operating rods 29 can be thus operated with a higher accuracy.

Still further, no swing link is provided in the center piece 21 to change the operating force added to the resistance contacts 23. This makes it quite easier to assemble or process the swing link 30 for the main contacts 22. The operating mechanisms 31 and 32 outside the tank 25 can also be left so full of space as to make it easier to assemble them.

Figure 7:
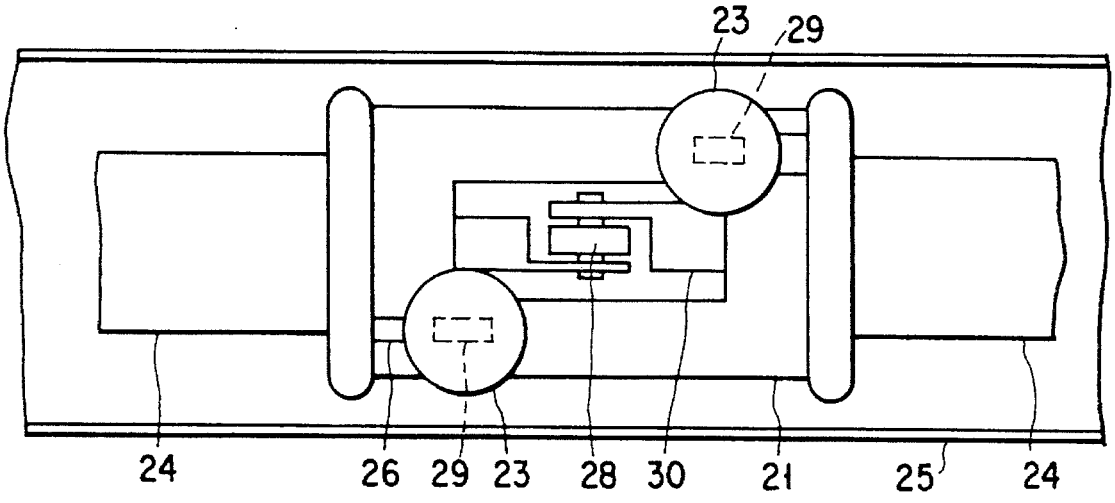
FIG. 7 is a plan showing the UHV breaker provided with resistances according to another embodiment of the present invention.

The resistance-provided breaker of the present invention is not limited to the above-described ones but it may be embodied as shown in FIG. 7. The breaker shown in FIG. 7 is characterized in that two resistance contacts 23 are arranged on a diagonal line of the center piece 21. According to this embodiment, the distance between the resistance contacts 23 and 23 in the longitudinal direction of the tank 25 is same as those in the above-described first and second embodiments, but it can be made actually longer by 20–30%. This makes the insulating distance long enough to enable a higher insulating effect to be achieved. In addition, the resistance contact operating rods 29 are also arranged on the diagonal line of the center piece 21. A larger space can be thus kept in the tank 25 to make it easier to do any work in it.

Although each of the main contact, resistance and resistance contact units has included two elements in the above-described first and second embodiments, it may include one or more than three. Further, the resistance unit may be arranged not parallel to the mean contact unit but along the longitudinal direction of the tank. The resistance contact unit may be arranged, crossing the longitudinal direction of the tank.

According to the present invention as described above, the main contacts, the resistance contacts and the resistances can be arranged in so a better balance in the tank as not to leave any unnecessary space in the tank. This enables the breaker to be made smaller in size. In addition, the link between each contact and the operating mechanism can be made so simpler as to make the breaker more reliable. Further, the breaker can fix large and heavy resistances in it with a higher stability.

According to the present invention, the insulating distance between two resistance contacts can be kept long enough and the whole of the breaker including the tank can be made smaller in size.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A resistance-provided UHV breaker, comprising:

a tank having a longitudinal direction;

a main contact unit arranged parallel to the longitudinal direction of the tank;

a resistance unit arranged parallel to the longitudinal direction of the tank; and resistance contact unit cooperating with the resistance unit to form a resistant parallel circuit and arranged perpendicular to the longitudinal direction of the tank.

2. The resistance-provided UHV breaker according to claim 1, wherein said main contact unit includes plural main contacts arranged parallel to the longitudinal direction of said tank.

3. The resistance-provided UHV breaker according to claim 1, wherein said resistance unit is arranged parallel to the main contact unit.

4. The resistance-provided UHV breaker according to claim 1, wherein said resistance unit includes plural resistances arranged parallel to the longitudinal direction of said tank.

5. The resistance-provided UHV breaker according to claim 1, wherein said resistance contact unit is arranged perpendicular to the longitudinal direction of said tank.

6. The resistance-provided UHV breaker according to claim 1, wherein said resistance contact unit includes plural resistance contacts arranged perpendicular to the longitudinal direction of said tank.

7. The resistance-provided UHV breaker according to claim 1, wherein said main and resistance contact units are opened and closed by an operating mechanism, arranged outside the tank.

8. A resistance-provided UHV breaker according to claim 1, further comprising:

a center piece arranged in the center of the tank when viewed in the longitudinal direction of said tank, and connected to said main contact unit and said resistance contact.

9. The resistance-provided UHV breaker according to claim 8, wherein said resistance contact unit is arranged at a position shifted from a center of the center piece.

10. The resistance-provided UHV breaker according to claim 8, wherein said resistance contact unit is arranged, crossing the longitudinal direction of the tank, and connected to the center piece at those positions which are adjacent to both ends of the center piece.

11. The resistance-provided UHV breaker according to claim 8, wherein said plural resistance contacts are arranged opposite to each other on the center piece.

12. The resistance-provided UHV breaker according to claim 8, wherein said plural resistance contacts are diagonally arranged on the center piece.

* * * * *